United States Patent [19]

Williams

[11] Patent Number: 4,795,036

[45] Date of Patent: Jan. 3, 1989

[54] ROTARY DISC SCREEN CONVEYOR APPARATUS

[75] Inventor: Robert M. Williams, Ladue, Mo.

[73] Assignee: Williams Patent Crusher and Pulverizer Company, St. Louis, Mo.

[21] Appl. No.: 61,456

[22] Filed: Jun. 15, 1987

[51] Int. Cl.[4] ..... B07B 13/04

[52] U.S. Cl. ..... 209/667; 209/672; 403/344

[58] Field of Search ..... 209/672, 671, 667, 271, 209/261; 403/344 X

[56] References Cited

U.S. PATENT DOCUMENTS

| | | | |
|---|---|---|---|
| 1,641,777 | 9/1927 | Newhouse | 209/672 |
| 1,679,593 | 8/1928 | Williamson et al. | 209/672 |
| 3,306,441 | 2/1967 | Sanders et al. | 209/672 |
| 4,239,119 | 12/1980 | Kroell | 209/672 |
| 4,301,930 | 11/1981 | Smith | 209/672 |
| 4,452,694 | 6/1984 | Christensen et al. | 209/672 |
| 4,538,734 | 9/1985 | Gill | 209/672 |

FOREIGN PATENT DOCUMENTS

| | | | |
|---|---|---|---|
| 518605 | 1/1931 | Fed. Rep. of Germany | 209/672 |
| 1397280 | 3/1965 | France | 209/672 |

*Primary Examiner*—Johnny D. Cherry
*Assistant Examiner*—Donald T. Hajec
*Attorney, Agent, or Firm*—Gravely, Lieder & Woodruff

[57] ABSTRACT

A rotary disc screen apparatus consisting of a material screening frame having a series of corotating parallel shafts in spaced relation, screen discs mounted on supports on the shafts so the screen discs interleave between adjacent shafts, the screen discs being detachable from the supports for interchangeability with other screen discs of a selected different dimension, and drive assemblies connected to alternate one of the shafts for being able to apply the drive assemblies on adjacent jammed shafts when needed.

1 Claim, 2 Drawing Sheets

ROTARY DISC SCREEN CONVEYOR APPARATUS

BACKGROUND OF THE INVENTION

1. Field of the Invention

This invention relates to improvements in the construction of the disc screen conveyor rotors and in the drive arrangement for rotary disc screen conveyor apparatus.

2. Description of the Prior Art

An example of the prior art is seen in U.S. Pat. No. 4,452,694 of June 5, 1984 where a common drive for the several shafts comprises a chain engaged with sprockets on each shaft so that the power input from a single electric motor is connected to all of the shafts. The shafts support disc members that interleave between shafts to form openings between adjacent discs for the passage of material which is small enough to drop through. Such prior art apparatus is seen in U.S. Pat. No. 4,301,930 of Nov. 24, 1981. A further example of a rotary disc screen apparatus is seen in my prior patent U.S. Pat. No. 4,658,964 of Apr. 21, 1987.

Rotary disc screen apparatus is employed for handling a variety of material where the intent is to separate small components from components having large surfaces for effecting a sortation process to remove small size components from larger components.

A problem with prior rotary disc screen apparatus is that the construction of the shafts and discs do not allow for easy or rapid changing the discs or the spacing between discs, as it is frequently necessary to adapt the screen to a variety of material to obtain a larger or smaller size of components capable of passing through the screen. Currently, the rotary disc screen apparatus is practically adapted for one type of material, and if it is a requirement to be able to interchangeably handle a variety of material for screening out components having different size requirements the shafts and discs must be dismantled in order to install different discs for such different materials.

A further problem with the current types of rotary disc screen apparatus is that a single drive motor is provided to drive a substantial number of shafts or a series of shafts. When a jam occurs between discs of adjacent shafts, the torque provided from a common drive motor has been found to be insufficient to overcome such a jam. Accordingly, the motor needs to be reversed to free up the jam, and that interrupts the output of the material being screened.

SUMMARY OF THE INVENTION

Among the several objects of the present invention is the provision in rotary screen apparatus of a construction wherein the screen opening between interleaved discs may be changed without requiring a dismantling of the shafts as heretofore required.

Another object of the present invention is to provide rotary discs that can be removed and exchanged for other discs without requiring removal o the shafts so that improved utility of one assembly is gained by adapting the rotary shafts to accommodate discs that are interchangeable to provide different screen openings.

A further object of the present invention resides in an improved drive arrangement such that in a given length of a rotary disc screen conveyor alternate shafts have a common motor whereby the torque from different motors may be concentrated on a pair of adjacent shafts which are jammed by material that refuses to pass through the opening between adjacent discs.

BRIEF DESCRIPTION OF THE DRAWINGS

The present rotary disc screen conveyor apparatus is disclosed in a preferred embodiment, wherein.

DETAILED DESCRIPTION OF THE PREFERRED EMBODIMENT

Figure 1:
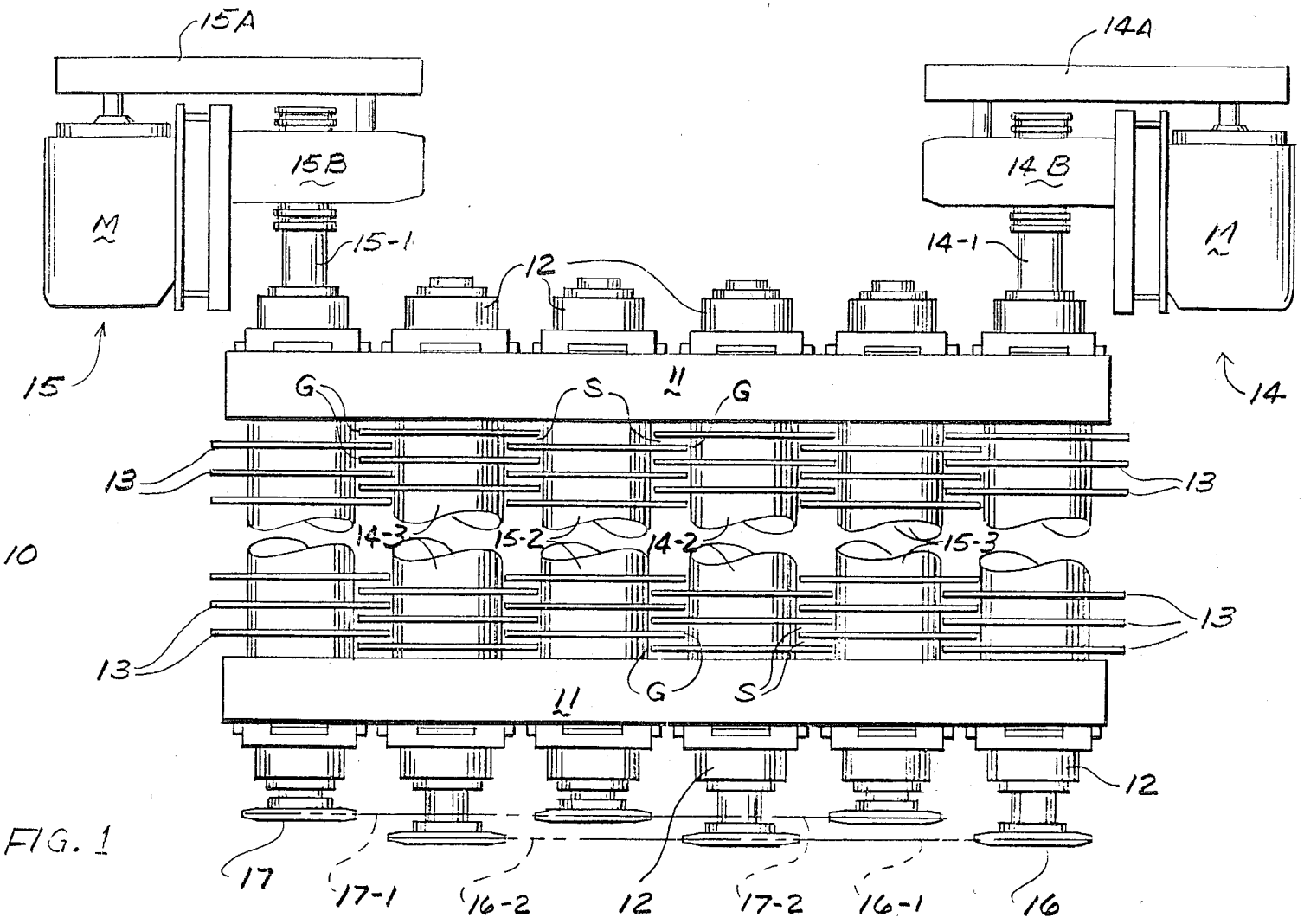
FIG. 1 is a schematic plan view of a fragmentary length of a conveyor apparatus in which alternate disc carrying shafts have a common drive source so that any two adjacent shafts have different drive sources, whereby double the drive power is capable of being applicable to a jam between the adjacent shafts.

Referring to FIG. 1 there is disclosed a fragmentary length of conveyor apparatus 10 in which the improved discs are incorporated. It is to be noted that the frame members 11 of the apparatus have bearing assemblies 12 for supporting the shafts in parallel spaced relation. Each shaft is adapted, as will be referred to presently, to support a group of disc assemblies 13 with the groups of disc assemblies on each shaft being in overlapped relation with other disc assemblies on adjacent shafts. Where the disc assemblies overlap or interleave there are radial gaps G between adjacent shafts and axial spaces S formed of a predetermined size or space between adjacent discs for determining a screen passage for escape of the small fractions of the material being conveyed on the conveyor apparatus, these spaces and gaps can be changed in dimensions, both parallel to the axes of the shafts and radially between those shafts. Thus, a two dimensional change is possible by the proper selection of the thickness and the radial dimension of the disc assemblies.

In FIG. 1, there are two drive assemblies 14 and 15 arranged so that the drive assembly 14 is connected by shaft 14-1 and the opposite end of that shaft carries a sprocket 16 which is connected by a suitabe drive chain 16-1 to a sprocket on shaft 14-2, and a second drive chain 16-2 connects up to a sprocket on shaft 14-3, whereby the three shafts 14-1, 14-2 and 14-3 are connected up to the drive assembly 14 consisting of an electric motor M connected through a belt drive unit 14A to a gear reducer unit 14B so the speed of the shaft 14-1 meets the requirement. A second drive assembly 15 is connected to shaft 15-1 and the opposite end of shaft 15-1 carries a sprocket 17 connected by a suitable drive chain 17-1 to a sprocket on shaft 15-2, and a second drive chain 17-2 connects up to a sprocket on shaft 15-3, whereby the three shafts 15-1, 15-2 and 15-3 are connected up to the drive assembly 15 consisting of an electric motor M connected through a belt drive unit 15A to a gear reducer unit 15B to get the proper speed for shaft 15-1. The drive assemblies 14 and 15 must be arranged so that the shafts all turn in the same direction.

It is observed that the shafts 14-1 to 14-3 alternate with the shafts 15-1 to 15-3. This alternating drive of the shafts will be practiced throughout the intended length of the conveyor apparatus. The purpose for arranging separate drive assemblies for alternating shafts is to obtain the torque from two drive assemblies applied to two adjacent shafts that may be jammed by material unable to pass through the space between interleaved discs on the two shafts.

Figure 2:
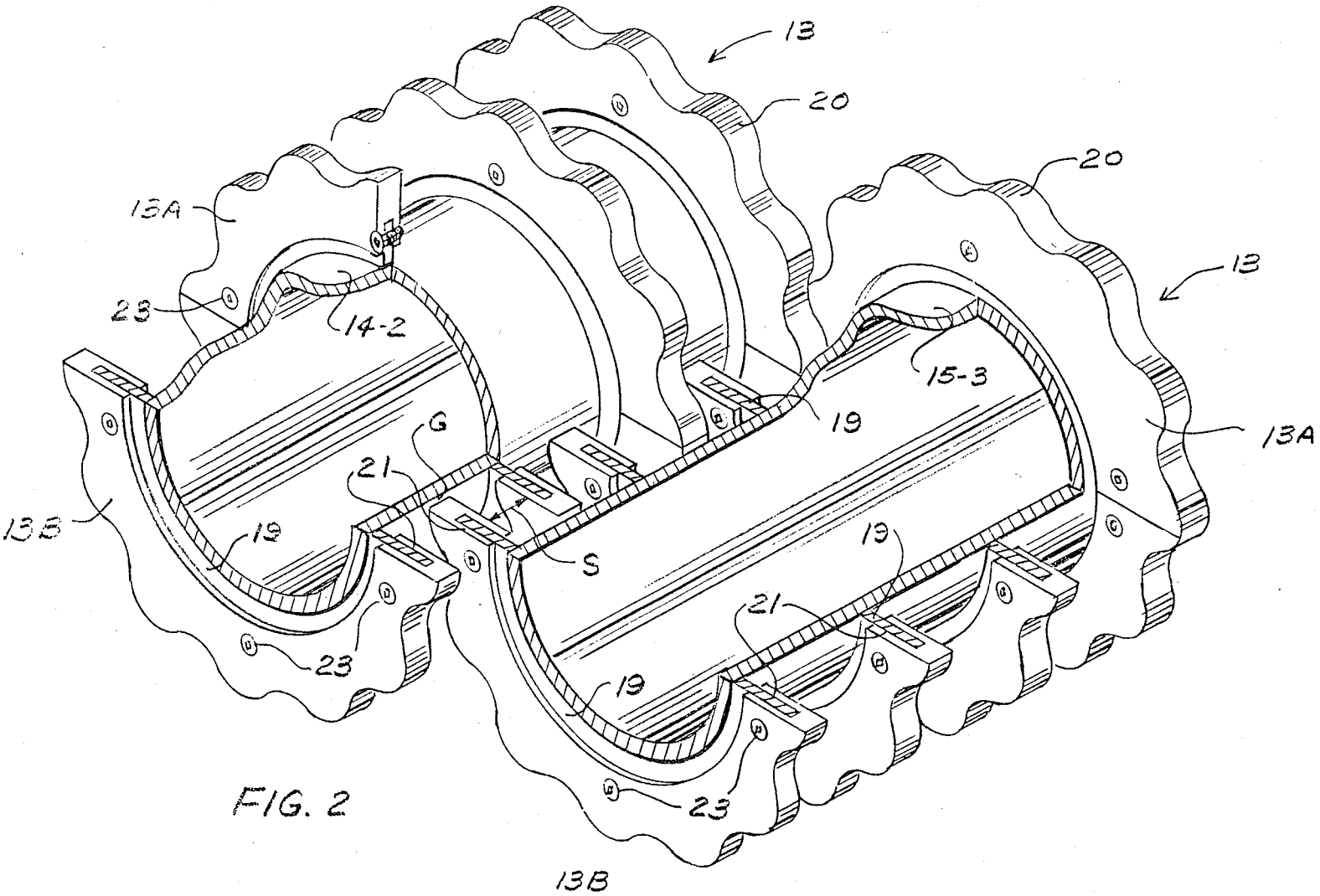
FIG. 2 is a fragmentary perspective view on an enlarged scale of portions of a pair of adjacent shafts with provision for allowing interchangeability of drive caps on the shaft ribs for adapting the dimensions of screen openings in the conveyor to suit the material to be conveyer.

Turning now to FIG. 2 adjacent and parallel portions of shafts 14-2 and 15-3 are seen in FIG. 1 in a schematic view. Each of the shafts is provided with a series of fixed supports such as circumferential rib rings 19 arranged in axially spaced positions and encircling the shaft external surfaces to extend radially outwardly from the shaft. Each of the rib rings 19 supports discs 13, and in this view the discs are split into semi-circular and complementary parts 13A and 13B in order to facilitate the mounting or removal of the disc parts 13A and 13B of any one disc from any other disc thereby making the discs independent of each other. The discs shown are formed with undulating peripheral surfaces 20 to impart an up and down motion to the material being conveyed by the rotational action of discs as is well understood in this art. In view of the undulating surface 20, the radial dimension will alternate the size of the gap G between the greatest and least opening in a periodic manner.

In the view of FIG. 2, the semi-circular disc parts 13A and 13B are formed worth grooves 21 or suitable recessed surface on the inner edges so that when assembled on the supports the grooves or recessed surface will embrace the supporting ribs. Adjacent discs 13 on the pair of shafts 14-2 and 15-3 are spaced apart to determine the dimension of the slots S formed in the assembled rotary disc screen. By choosing the radial dimension of the disc rings parts 13A and 13B, a radial gap G is left between the periphery 20 on the discs and the surface of the adjacent shaft. The disc part formed with the grooves 21 form caps for the supports or rib rings 19, and suitable securing means 23 hold the parts of the disc in assembled positions on the supports 19.

If the dimensions S and G are excessive for that illustrated, the disc parts 13A and 13B can be exchanged for thicker parts, and the radial dimension can be increased to leave only a small running clearance with the adjacent shaft. Either dimension S or G can be varied independently of the other. As is seen in FIG. 1, the screening out of fractions of the total material moved on the discs occurs in the spaces between adjacent shafts. Changes in these spaces are easily accomplished by removing the disc parts shown from the shafts and installing other thicker or thinner disc parts that will provide the slot S and gap G spaces at the zones where the discs interleave with each other.

It should now be understood that instead of welding a set of discs in spaced relation on the rotary shafts, or of rotating shafts with accurately spaced and fixed supports or rib rings so that these rib rings remain in position on all of the shafts. Thereafter, individual screen disc components of semi-circular shape are adapted to be secured on the supports so as to overcome the tedious work heretofore required of mounting a set of entire ring shaped discs on the shafts. Proceeding in the manner disclosed above, the semi-circular or split discs of any desired shape can be quickly secured on the fixed rib rings, and as easily removed to make way for differently dimensioned disc components.

In applying the foregoing principal to the rotary disc screen apparatus, the corotating shafts may first be equipped with the axially spaced series of radially extending and circumferentially directed supports which may be rib rings, making certain that the rib rings on adjacent shafts are in spaced interleaved relationship and sufficiently axially spaced to leave room for receiving the split or two part disc ring parts 13A and 13B. The thus prepared shafts can be mounted in the bearings 12 in the material screening frame 11 and connected up to the drive assemblies 14 and 15 in alternate shaft drive relation. Then the selected complementary disc parts with suitable recesses to match the rib ring can be mounted on the supports already on the corotating shafts. No disturbance of shafts and bearings is necessary and no clamping means is required.

It will be understood that certain modifications can be made in the dimensions of the discs rings to satisfy the screening of the type of material being processed on the subject apparatus.

What is claimed is:

1. A rotary disc screen apparatus consisting of a material screening frame having a series of co-rotating and spaced parallel and axially elongated shafts, each of which shaft has thereon an axially spaced apart series of discs which interleave between spaced parallel shafts, and comprising:

each of said shafts having a series of axially spaced supports thereon encircling the shafts and extending radially outwardly from the shafts;

a series of discs carried one on each said shaft encircling support, each one of said discs being divided into complementary parts, each complementary part being formed with a recessed surface to abut a shaft support and form a complete disc that encircle the shafts; and means for securing said complementary parts of each disc in position on a common shaft support with the discs relying upon said supports for establishing the axial spacing of said discs, and wherein said securing means detachably connects said complementary parts of said discs to said supports independently of adjacent discs.

* * * * *

UNITED STATES PATENT AND TRADEMARK OFFICE

CERTIFICATE OF CORRECTION

PATENT NO. : 4,795,036

DATED : January 3, 1989

INVENTOR(S) : Robert M. Williams

It is certified that error appears in the above-identified patent and that said Letters Patent is hereby corrected as shown below:

Column 1, line 59, delete "o" and insert "of".

Column 2, line 18, delete "conveyor" and insert "conveyed".

Column 3, line 25, delete "worth" and insert "with".

Column 3, line 26, delete "surface" and insert "surfaces".

Column 3, line 53, after "of" and before "rotating", insert "making a tubular sleeve with a set of welded on discs and then sliding the sleeve on the rotary shaft and securing the sleeve to the shaft so as to transmit the torque of shaft rotation to the sleeve, the present invention makes each of the co-".

Signed and Sealed this

Fifteenth Day of August, 1989

*Attest:*

DONALD J. QUIGG

*Attesting Officer*

*Commissioner of Patents and Trademarks*